US009836027B2

(12) United States Patent
Willemin et al.

(10) Patent No.: US 9,836,027 B2
(45) Date of Patent: Dec. 5, 2017

(54) WINDING DEVICE FOR SELF-WINDING AUTOMATIC WATCH

(71) Applicant: THE SWATCH GROUP RESEARCH AND DEVELOPMENT LTD, Marin (CH)

(72) Inventors: Michel Willemin, Preles (CH); Jean-Jacques Born, Morges (CH); Francois Klopfenstein, Delemont (CH); Patrick Ragot, Fontainemelon (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 14/768,610

(22) PCT Filed: Mar. 20, 2014

(86) PCT No.: PCT/EP2014/055662
§ 371 (c)(1),
(2) Date: Aug. 18, 2015

(87) PCT Pub. No.: WO2014/166719
PCT Pub. Date: Oct. 16, 2014

(65) Prior Publication Data

US 2016/0004223 A1 Jan. 7, 2016

(30) Foreign Application Priority Data

Apr. 10, 2013 (EP) ..... 13163158

(51) Int. Cl.
*G04B 5/00* (2006.01)
*G04B 5/16* (2006.01)
(Continued)

(52) U.S. Cl.
CPC ..... *G04D 7/009* (2013.01); *G04B 5/00* (2013.01); *G04B 5/14* (2013.01); *G04B 5/165* (2013.01);
(Continued)

(58) Field of Classification Search
CPC ... G04G 5/00; G04G 5/05; G04G 5/14; G04B 5/00; G04B 5/05; G04B 5/14; G04C 1/02;
(Continued)

(56) References Cited

U.S. PATENT DOCUMENTS 2,620,620 A * 12/1952 Meyer ..... G04B 7/00 188/82.1
3,058,294 A 10/1962 Zemla et al.
(Continued)

FOREIGN PATENT DOCUMENTS

CH 706352 A2 10/2013
EP 2650735 A2 10/2013
(Continued)

OTHER PUBLICATIONS

International Search Report dated May 8, 2015 for PCT/EP2014/055662 filed on Mar. 20, 2014.

*Primary Examiner* — Vit W Miska
*Assistant Examiner* — Daniel Wicklund
(74) *Attorney, Agent, or Firm* — Oblon, McClelland, Maier & Neustadt, L.L.P.

(57) ABSTRACT

A device for winding automatic watches, including an electrical energy source and a receptacle support including a surface configured to receive in abutment a back cover of a watch, the device configured to generate a magnetic and/or electrostatic field or eddy currents, in a fixed position underneath the bearing surface and generate, on a substantially annular angular sector, a magnetic and or electrostatic
(Continued)

field that varies as a function of time and whose direction is orthogonal to the bearing surface, or generating eddy currents that vary as a function of time. The device can be provided for a watch including an automatic winding mechanism with an oscillating weight including a first ferromagnetic inner part and a second heavy metal peripheral part, and possibly with a paramagnetic conductive disc coaxial to the oscillating weight.

28 Claims, 3 Drawing Sheets

(51) Int. Cl.

| | |
|---|---|
| ***G04C 1/02*** | (2006.01) |
| ***G04B 13/00*** | (2006.01) |
| ***G04D 7/00*** | (2006.01) |
| ***G04B 5/14*** | (2006.01) |

(52) U.S. Cl.
CPC ..... *G04B 13/00* (2013.01); *G04C 1/02* (2013.01); *G04C 1/022* (2013.01); *G04C 1/024* (2013.01); *G04C 1/026* (2013.01); *G04C 1/028* (2013.01)

(58) Field of Classification Search
CPC ..... G04C 1/022; G04C 1/024; G04C 1/025; G04C 1/028
USPC ..... 368/206–208
See application file for complete search history.

(56) References Cited

U.S. PATENT DOCUMENTS

| | | | | | |
|---|---|---|---|---|---|
| 3,635,011 | A | | 1/1972 | Pindell et al. | |
| 3,652,955 | A | * | 3/1972 | Cruger | G04C 3/024 310/25 |
| 4,057,885 | A | * | 11/1977 | Giger | G04B 5/16 29/509 |
| 4,644,246 | A | * | 2/1987 | Knapen | H02K 37/02 310/156.01 |
| 5,278,806 | A | * | 1/1994 | Affolter | G04C 10/00 368/179 |
| 5,684,761 | A | * | 11/1997 | Chen | G04C 10/00 368/179 |
| 5,878,004 | A | * | 3/1999 | Miyauchi | G04G 13/021 368/230 |
| 5,923,619 | A | * | 7/1999 | Knapen | G04C 10/00 310/75 A |
| 6,354,731 | B1 | * | 3/2002 | Halter | G04B 45/02 368/148 |
| 7,306,364 | B2 | * | 12/2007 | Born | G04B 17/063 368/148 |
| 2006/0239124 | A1 | * | 10/2006 | Thumm | G04B 5/00 368/88 |
| 2008/0101163 | A1 | * | 5/2008 | Bravo | G04B 5/165 368/148 |
| 2011/0163714 | A1 | * | 7/2011 | Ettes | H02J 7/025 320/108 |
| 2012/0082011 | A1 | * | 4/2012 | Liao | G04D 7/009 368/206 |
| 2012/0243387 | A1 | * | 9/2012 | Jamin | G04B 5/16 368/151 |
| 2013/0114381 | A1 | * | 5/2013 | Kaelin | G04B 5/165 368/208 |
| 2013/0170330 | A1 | * | 7/2013 | Hessler | G04B 13/00 368/324 |
| 2015/0117164 | A1 | * | 4/2015 | Ng | G04D 7/009 368/208 |
| 2015/0311741 | A1 | * | 10/2015 | Baker | H02J 7/025 320/108 |

FOREIGN PATENT DOCUMENTS

| | | | |
|---|---|---|---|
| FR | 555777 | A | 7/1923 |
| FR | 759771 | A | 2/1934 |
| FR | 1242820 | A | 10/1960 |
| FR | 1546744 | A | 11/1968 |
| FR | 2076082 | A1 | 10/1971 |
| JP | 2010-286428 | A | 12/2010 |

* cited by examiner

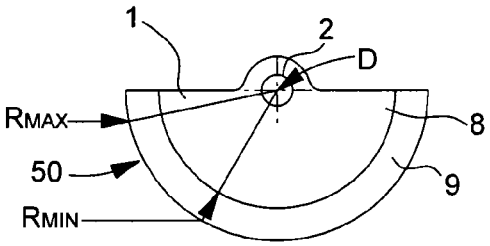
Fig. 2
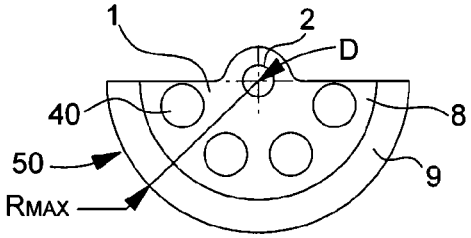
Fig. 3
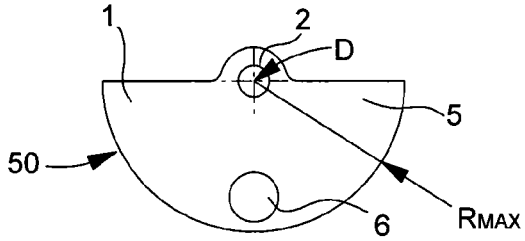
Fig. 4
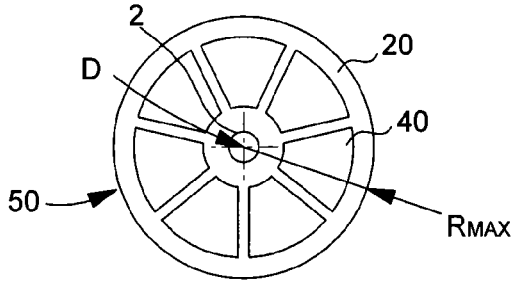
Fig. 5
Fig. 6
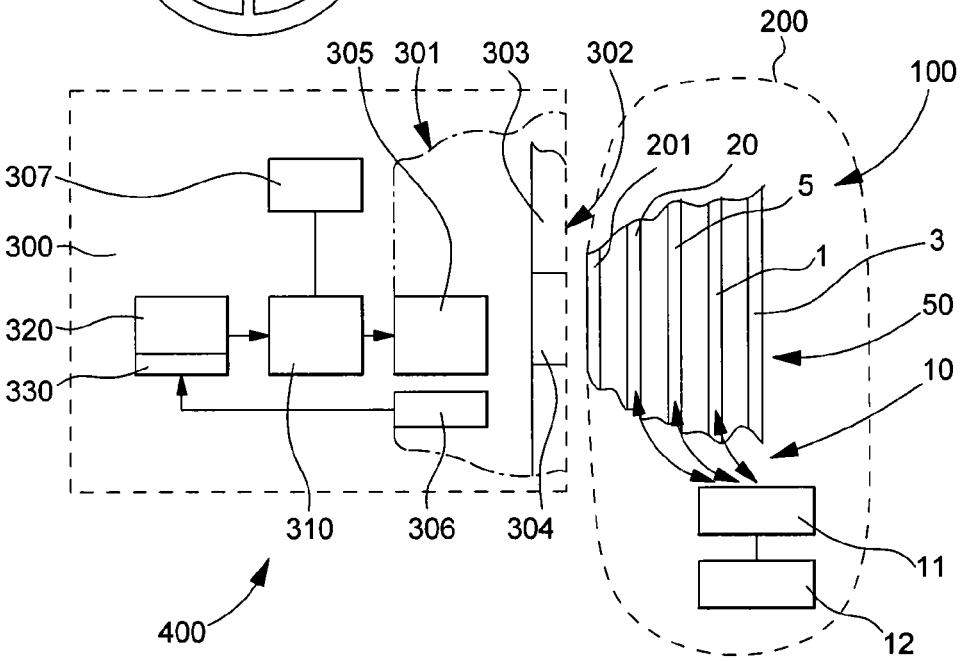

WINDING DEVICE FOR SELF-WINDING AUTOMATIC WATCH

CROSS-REFERENCE TO RELATED APPLICATIONS

This is a National phase Application in the United States of International patent application PCT/EP2014/055662 filed Mar. 20, 2014 which claims priority on European patent application No. 13163158.2 filed Apr. 10, 2013. The entire disclosures of the above patent applications are hereby incorporated by reference.

FIELD OF THE INVENTION

The invention concerns a winding mobile member for an automatic watch winding mechanism, including a guide member on the pivot axis thereof and inscribed in a cylinder of maximum radius, and including means for driving an energy charging mechanism.

The invention also concerns an automatic watch winding mechanism including at least one moving mechanical weight for recharging at least one barrel or accumulator with mechanical energy.

The invention also concerns a timepiece movement including at least one barrel or one mechanical energy accumulator, and at least one such automatic winding mechanism.

The invention further concerns a self-winding automatic watch, including at least one such movement, and/or at least one barrel or one mechanical energy accumulator, and at least one such automatic winding mechanism.

The invention further concerns a device for winding automatic watches, including at least one electrical accumulator, and at least one receptacle support for a watch, said receptacle support including a bearing surface intended to receive in abutment the back cover of a watch.

The invention further concerns a timepiece assembly including such a device, and at least one such watch.

The invention concerns the field of horology and more specifically the winding of automatic watches.

BACKGROUND OF THE INVENTION

The user of a self-winding automatic watch which is not permanently worn is obliged, when he wishes to use it, to perform display updating tasks, which may be tedious as regards dates, or difficult or even impossible as regards complications such as moon phases or leap years in a perpetual calendar.

Watch winding cases or individual winders are known which simulate the movements of a user by rotating the watch, in general about several axes, to provide the oscillating weight with the impulses required for winding. These winding cases or winders are often voluminous, expensive and the movement may disturb the user. In particular, such winders are not suitable for a commercial environment, where a watch has to be exhibited in a static fashion to clients, with a correct time information display, and also be ready for demonstration.

U.S. Pat. No. 3,058,294 discloses an inertia wound watch including magnetic coupling means.

European Patent Application No. 2650735A2 discloses a device for winding automatic watches by magnetic or electrostatic drive of an oscillating weight.

CH Patent Application No. 706352A2 discloses a contactless torque transfer by magnetic or electrostatic drive.

FR Patent No. 1242820 discloses a self-winding automatic watch with no pivoted arbor.

FR Patent No. 2076082 discloses an elapsed time indicator with an electromagnetic device.

JP Patent No. 2010286428 discloses an energy generation device for a watch by electrostatic induction.

FR Patent No. 555777 discloses an automatic eddy current switch driver.

FR Patent No. 759771 discloses an eddy current motor for winding a clock.

FR Patent No. 1546744 discloses an automatic watch with winding and time-setting by magnetic influence.

SUMMARY OF THE INVENTION

The invention proposes to make available to the user simple, inexpensive and compact means for winding a self-winding automatic watch and permanently maintaining the maximum potential power reserve even if the watch is not worn.

To this end, the invention concerns a winding mobile member for an automatic watch winding mechanism.

The invention also concerns an automatic watch winding mechanism including at least one moving mechanical weight for recharging at least one barrel or accumulator with mechanical energy.

The invention further also concerns an automatic watch winding mechanism including at least one moving mechanical weight for driving a microgenerator in order to charge recharge an electrical accumulator.

The invention also concerns a timepiece movement including at least one such automatic winding mechanism.

The invention also concerns a self-winding automatic watch at least one such automatic winding mechanism.

The invention further concerns a device for winding automatic watches, including at least one electrical powering means or one electrical accumulator, and at least one receptacle support for a watch, said receptacle support including a bearing surface intended to receive in abutment the back cover of a watch, characterized in that said device includes means for the generation of a magnetic and/or electrostatic field disposed in a fixed position underneath said bearing surface and generating, on at least one path, at least one field that is magnetic and/or electrostatic and/or of variable intensity and/or direction as a function of time.

The invention further concerns a timepiece assembly including such a device, and at least one such watch, characterized in that said device includes regulating and control means for the control of said generation means, and in that said regulating and control means and said generation means are adapted and formatted for the driving of:

- either at least one moving magnetic weight comprised in said at least one watch, for recharging at least one barrel or accumulator with mechanical energy, or for driving a microgenerator to recharge an electrical energy accumulator,
- or at least one paramagnetic conductive disc coaxial to said moving mechanical weight comprised in said at least one watch, and, like said at least one moving mechanical weight, arranged for recharging at least one barrel or accumulator with mechanical energy, or for driving a microgenerator for recharging an electrical energy accumulator,
- or at least one moving magnetic weight comprised in said at least one watch, and at least one paramagnetic conductive disc coaxial to said moving mechanical weight, comprised both in said at least one watch for recharging at least one barrel or accumulator with mechanical energy, or for driving a microgenerator to recharge an electrical energy accumulator, for driving, depending on the case, said at least one moving magnetic weight by means of magnetic coupling, and/or said at least one disc by means of eddy currents.

BRIEF DESCRIPTION OF THE DRAWINGS

Other features and advantages of the invention will appear upon reading the following detailed description, with reference to the annexed drawings, in which:

FIG. 2 shows a schematic, front view of a moving magnetic weight according to the invention.

FIG. 3 shows the moving magnetic weight of FIG. 2, modified by the addition of cut-outs.

FIG. 4 shows a schematic, front view of a moving weight with a magnet according to the invention.

FIG. 5 shows a schematic, front view of a paramagnetic conductive disc according to the invention, in a particular variant including apertures.

FIG. 6 is a diagram showing the interactions between the circuits forming a winding device according to the invention on the one hand, and between the components of a watch winding mechanism on the other hand.

DETAILED DESCRIPTION OF PREFERRED EMBODIMENTS

Figure 1:
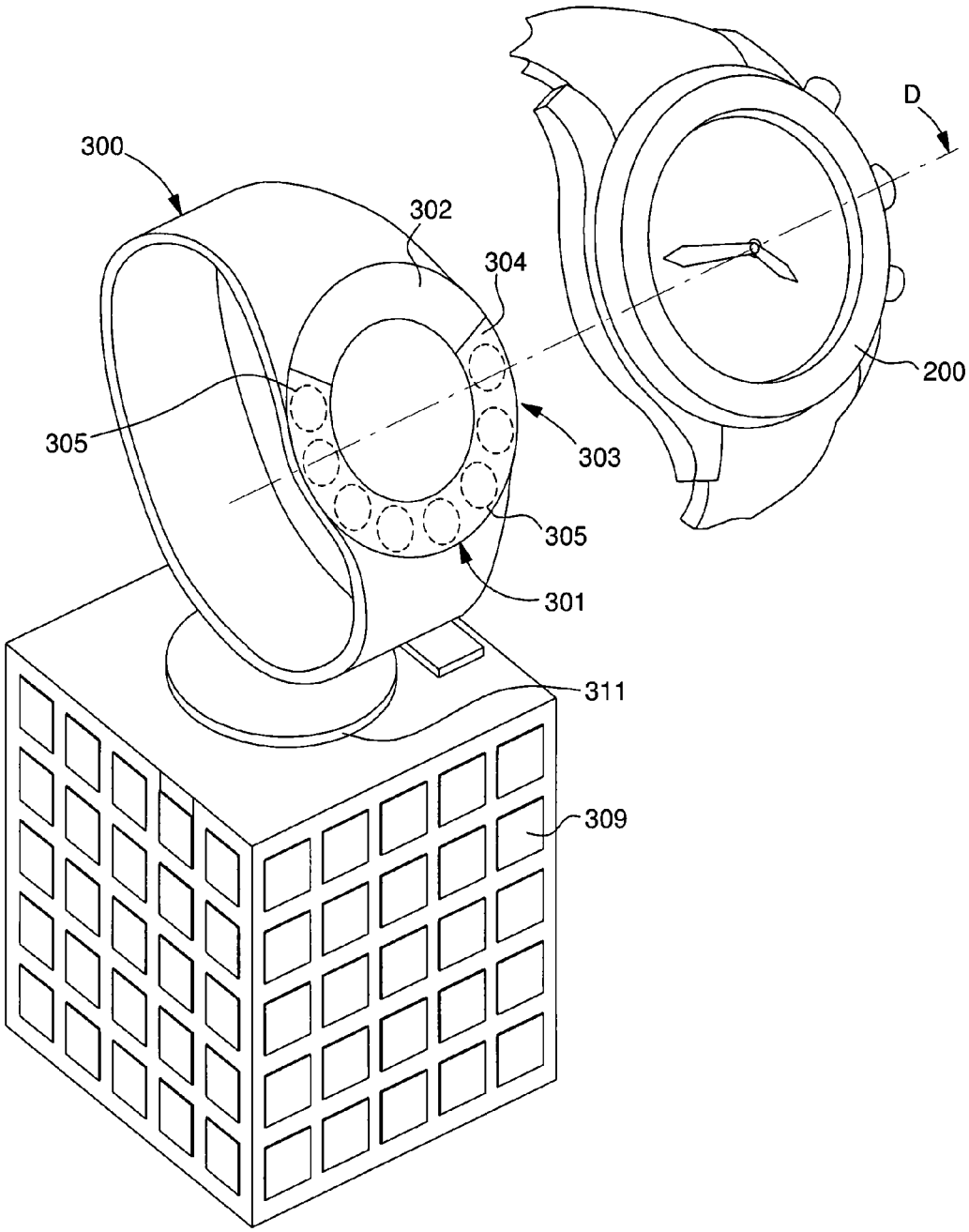
FIG. 1 shows a schematic, perspective view of a timepiece assembly according to the invention including an automatic winding device according to the invention and a self-winding automatic watch.

The invention concerns simple, inexpensive and compact means for winding a self-winding automatic watch.

These means include means for generation of a rotating field, i.e. a field that is magnetic and/or electrostatic and/or of variable intensity and/or direction as a function of time. As will be seen below, this field, called a rotating field, can be deployed along any linear, circular or other profile.

The principle of the invention is to drive a mobile member for recharging a mechanical energy accumulator such as a barrel or to drive a mobile member which in turn drives a microgenerator which recharges an electrical accumulator, by means of an electromagnetic force or by means of eddy currents, depending on the material forming the mobile member. A mobile member driven by electromagnetic forces is called an "oscillating weight" here and generally adopts the form of a conventional mechanical oscillating weight in a disc sector. A mobile member driven by means of eddy currents preferably includes a closed surface around its pivot axis, and is similar to a disc, and is referred to as such in the following description. An oscillating weight may be extended without limitation to a mechanical weight for example moving in translation.

In a preferred implementation of the invention, these winding means go together with watches adapted for optimal operation.

Although the winding means according to the invention are, in principle, capable of driving a conventional steel oscillating weight, they are not immediately best suited to drive an oscillating weight made of gold or in the form of a sector which does not allow optimal flow of eddy currents.

The invention is developed to permit easy adaptation of existing oscillating weights to the winding mechanism, without significantly changing the movement. It is suitable for simply replacing a standard oscillating weight with a weight having a particular composition of materials.

In the variant using an eddy current drive, the invention provides for the addition of a disc, preferably coaxially to the mechanical oscillating weight of the watch. This original oscillating mechanical oscillating weight must therefore remain in place to ensure winding or driving when the watch is worn. The modification of the movement is thus limited, especially since the disc can be mounted, either independently of the mechanical oscillating weight, or integral therewith, to engage either with the same drive ratchet of the barrel, or with a separate ratchet. This may of course be transposed to a microgenerator drive. The problems associated with driving the barrel in order to wind it are well known to those skilled in the art and are not addressed here.

The selection of materials for the watch winding mobile member is guided by the optimal behaviour of the mobile member according to the type of field to which it is subjected.

In the following discussion, "magnetically permeable" materials means materials having a relative permeability of between 10 and 10000 such as steels, which have a relative permeability close to 100 for balance staffs, for example, or close to 4000 for steels commonly used in electric circuits, or other alloys whose relative permeability reaches values of 8000 to 10000.

"Magnetic materials", for example in the case of pole pieces, means materials able to be magnetised so as to have a remanent field of between 0.1 and 1.5 Tesla, such as for example "Neodymium Iron Boron" with a magnetic energy density Em close to 512 kJ/m$^3$ and giving a remanent field of 0.5 to 1.3 Tesla. A lower level of remanent field, towards the bottom part of the range, may be used in the event of combination, in a magnetization pair, of a magnetic material of this type with a magnetically permeable antagonistic component with high permeability, closer to 10000 in the range from 100 to 10000.

"Ferromagnetic materials" means materials whose characteristics are: saturation field Bs>0 at temperature T=23° C., coercive field HC>0 at temperature T=23° C., maximum magnetic permeability $\mu_R$>2 at temperature T=23° C., Curie temperature Tc>60° C.

More specifically, "soft magnetic materials" means those with a smaller coercive field (Hc<1000 Nm) and a small hysteresis cycle.

More specifically, "hard magnetic materials" means those with a larger coercive field (Hc>3000 A/m) and a larger hysteresis cycle, for example permanent magnets.

"Paramagnetic" materials means materials with a relative permeability of between 1,0001 and 100, for example for spacer pieces inserted between a magnetic material and a magnetically permeable antagonistic component or between two magnetic materials, for example a spacer piece between a component and a pole piece. For example, low paramagnetic materials are: aluminium, gold, brass or similar (magnetic permeability of less than 2).

The invention concerns various devices:

- a winding mobile member 50 incorporated in the watch movement, and formed of one or more "oscillating" weights 1, 3, 5 and/or one or more discs 20. This winding mobile member 50 is driven:
  - either by magnetic or electrostatic attraction and/or repulsion;
  - or by means of eddy currents;
- a winding mechanism 10;
- a movement 100;
- a watch 200;
- a winding device 300;
- a timepiece assembly 400 including a winding device 300 and at least one watch 200.

The automatic watch winding mobile member 50 includes a guide member 2 on its pivot axis D. This mobile member 50 is inscribed in a cylinder of maximum radius RMAX centred on said axis D, and includes means for driving an energy recharging mechanism, such as a ratchet for driving a barrel or similar.

According to the invention, this mobile member 50 includes, either a ferromagnetic or magnetised part for driving mobile member 50 by means of a variable magnetic field, or an electrified part for driving mobile member 50 by means of a variable electrostatic field, or a paramagnetic conductive field surrounding pivot axis D over a sufficiently large diameter to drive mobile member 50 by means of eddy currents. It is understood, in this latter case, that this conductive ring is preferably at the periphery of mobile member 50 which will then be referred to as "disc" 20.

In a first variant, as seen in FIG. 2, winding mobile member 50 includes at least one magnetic oscillating weight 1 which includes a first inner ferromagnetic part 8 extending over radii smaller than the minimum radius RMIN of a second peripheral heavy metal portion 9. "Heavy metal" means a material with an atomic number of between 73 and 79, or an alloy including at least 80% of a heavy metal with an atomic number of between 73 and 79.

The RMIN/RMAX ratio is preferably greater than 0.5.

In a particular embodiment, which allows a high inertia magnetic oscillating weight 1, the second peripheral portion 9 includes at least 50% by mass of tungsten.

In another specific similar embodiment, the second peripheral portion 9 includes at least 90% by mass of tungsten and at least 20% by mass of gold.

In combination with one of these two tungsten-based embodiments, in yet another specific embodiment, the second peripheral portion 9 includes at least 20% by mass of iron.

In a particular embodiment, the first inner portion 8 is made of soft magnetic material.

FIG. 3 illustrates a variant of FIG. 2 wherein magnetic oscillating weight 1 includes apertures 40 in first inner portion 8.

FIG. 4 illustrates a winding mobile member 50 which includes at least one oscillating weight 5 with a magnet, including at least one component made of hard magnetic material 6 off-centre relative to said guide member 2.

In another, non-illustrated variant, winding mobile member 50 includes at least one electrified portion for driving mobile member 50 by means of a variable electrostatic field, which advantageously includes electrets.

It is understood that it is possible to combine, in the same mobile member, and particularly on different paths, on different diameters, and/or on different faces, and/or on different stages, areas capable of being driven, either by magnetic force, or by electrostatic force, or by means of eddy currents: there are numerous possible combinations, which are not discussed here to avoid overloading the present description.

For the variant with an eddy current drive, FIG. 5 shows a winding mobile member 50 which includes at least one disc 20 including at least one paramagnetic conductive ring surrounding said pivot axis D for driving said mobile member 50 by means of eddy currents.

The invention also concerns, inside the watch, an automatic watch winding mechanism 10 including at least one mechanical oscillating weight 3 for recharging at least one barrel or accumulator with mechanical energy.

According to the invention, this winding mechanism 10 includes, in addition to or in place of the at least one mechanical oscillating weight 3, at least one winding mobile member 50 as described above.

In particular, at least one winding mobile member 50 includes at least one cut-out 40.

The invention also concerns a timepiece movement 100 including at least one barrel or one mechanical energy accumulator, and at least one such automatic winding mechanism 10.

The invention also concerns a timepiece movement 100 including at least one microgenerator and one electrical energy accumulator, and at least one such automatic winding mechanism 10.

The invention further concerns a self-winding automatic watch 200, including at least one such movement 100, and/or at least one barrel or one mechanical energy accumulator or one microgenerator and one electrical energy accumulator and at least one such automatic winding mechanism 10.

In another implementation of the invention, for recharging at least one barrel or accumulator with mechanical energy, watch 200 includes only one paramagnetic conductive disc 20 arranged for recharging with mechanical energy at least one barrel or one accumulator or one microgenerator and one electrical energy accumulator, or several such discs 20.

The invention also includes a device 300 for winding automatic watches, including at least one electrical powering means or one electrical accumulator, and at least one receptacle support 301 for a watch.

The electrical powering means or electrical accumulator is advantageously housed inside a base provided with photovoltaic cells 309 as seen in FIG. 1, so as to power electrical field generation means.

This receptacle support 301 includes a bearing surface 302 intended to receive in abutment the back cover of a watch.

According to the invention, this device 300 includes means 310 for generation of a magnetic and/or electrostatic field disposed in a fixed position in an emission area 303 underneath bearing surface 302 and which generate, on at least one path main sector 340, at least one magnetic and/or electrostatic "rotating" field of variable direction and/or intensity and/or sense as a function of time.

Figure 8:
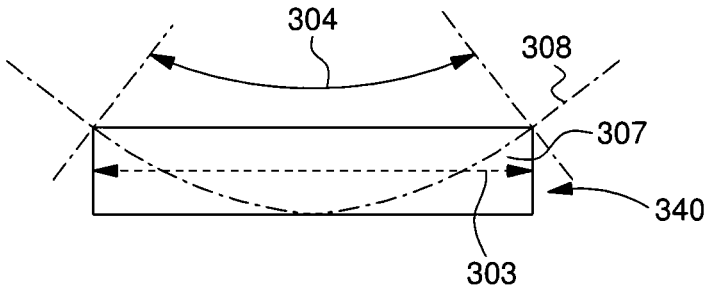
FIG. 8 shows, in a similar manner to FIG. 7, another variant wherein the rotating field emission area is in a linear segment.

In a particular embodiment according to FIG. 8, path main sector 340 includes at least one linear segment 307 of a substantially linear emission area 303. The generation means 310 generate, on this at least one linear segment 307, at least one magnetic and/or electrostatic field whose direction is substantially orthogonal or orthogonal to bearing surface 302 and whose intensity and/or sense is variable as a function of time.

Figure 9:
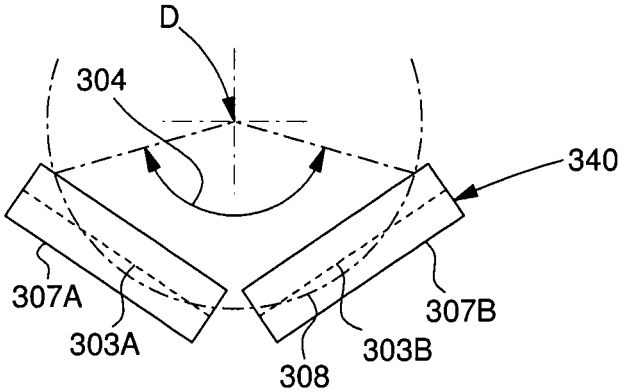
FIG. 9 shows, in a similar manner to FIG. 8, a derived variant, wherein the rotating field emission area is in two separate linear segments.

FIG. 9 illustrates a variant wherein path main sector 340 includes several such separate linear segments 307A, 307B: on each of which a rotating field is exerted in succession.

Figure 7:
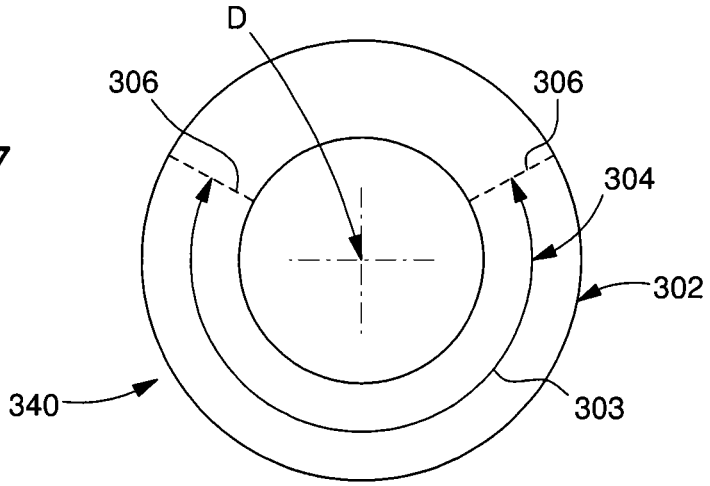
FIG. 7 shows a schematic, front view of a bearing surface comprised in an automatic winding device according to the invention, for receiving the back cover of a watch, in a variant where the device includes an area emitting a variable, rotating field in a circular sector.

In a preferred embodiment illustrated in FIG. 7, path main sector 340 includes at least one angular sector 304 of a substantially annular emission area 303. The generation means 310 generate, on this at least one angular sector 304, at least one magnetic and/or electrostatic field whose direction is substantially orthogonal or orthogonal to bearing surface 302 and whose intensity and/or sense is variable as a function of time.

In a particular embodiment, generation means 310 generate, on emission area 303, a plurality of such magnetic and/or electrostatic fields, parallel to each other in an orthogonal direction to bearing surface 302 and each of variable intensity and/or direction as a function of time.

In an advantageous embodiment illustrated in FIG. 1, generation means 310 include an array of coils 305 on all or part of emission area 303.

In a particular implementation illustrated by FIGS. 1, 7, 8 and 9, generation means 310 generate the magnetic and/or electrostatic field on an angular sector 304 of less than 240° centred on a median axis of bearing surface 302, alternately reciprocating from one end of angular sector 304 to the other. The winding axis D of the watch to be wound substantially coincides with this median axis when the watch is placed via its back cover 201 on bearing surface 302.

The trajectory 308 of the receiving path of drive mobile member 50 is illustrated in FIGS. 8 and 9. FIG. 7 shows the limits 306 of the emission area 303 actually active in such case. It will be noted that generation means 310 may, if necessary, be controlled to reverse the fields and brake mobile member 50 if its rotational speed is too high.

In another implementation, generation means 310 generate the magnetic and/or electrostatic field in a uniform direction of rotation over the entire 360° of bearing surface 302.

Naturally, the physical means for producing rotating fields may be identical, for example a complete annular array of coils 305, certain or all of which, according to the selected control mode, may be activated. To this end, device 300 advantageously includes regulating and control means 320 for controlling generation means 310.

In this preferred case, regulating and control means 320 include time management means and control the generation of a magnetic and/or electrostatic field at predefined moments or upon reception of a signal.

These regulating and control means 320 control the generation of the magnetic and/or electrostatic field in the form of a "rotating" field with a rotational speed Ω along angular sector 304 or emission area 303.

In a particular control mode, regulating and control means 320 accelerate the rotational speed Ω of said rotating field, from the moment that field generation starts to a moment when acceleration stops after a predefined duration.

Advantageously, regulating and control means 320 include reception means 330 arranged to measure the position and/or speed of a winding mobile member 50 driven under the effect of the magnetic and/or electrostatic field variation, and are capable of exerting reverse fields in the event of excessive rotational speed of a mobile member 50.

It is understood that, if, in a preferred manner, emission area 303 includes coils—or, more generally, field generation means—over its entire periphery, regulating and control means 320 can define particular cycles of field variation. For example, it is possible first of all to set in motion a weight in an alternating motion with a certain amplitude, then to modify this amplitude, or transform the alternating motion into a continuous motion. This tool is extremely flexible, and is limited only by the capacity of drive means 320.

In another variant, automatic watch winding device 300 includes at least one electrical powering means or one electrical accumulator, and at least one receptacle support 301 for a watch, this receptacle support 301 including a bearing surface 302 intended to receive in abutment the back cover of a watch. This device 300 includes motor means for driving at least one magnetic and/or electrical pole piece on an emission area 303 underneath bearing surface 302 and generating, on at least one path main sector 340, at least one magnetic and/or electrostatic field, of variable direction and/or intensity and/or sense as a function of time. More specifically, this winding mechanism includes at least one motor which drives one or more magnets and/or electrets which are coupled to magnets and/or electrets on the winding mobile member.

The invention also concerns a timepiece assembly 400 including at least one such device 300 and at least one such watch 200.

According to the invention, device 300 of this assembly 400 includes such regulating and control means 320 for controlling generation means 310 and these regulating and control means 320 and generation means 310 are adapted and formatted to drive at least one winding mobile member 50, which includes:

- either at least one magnetic "oscillating" weight 1, or an "oscillating" weight 5 with a magnet, comprised in said at least one watch 200, for recharging at least one barrel or accumulator with mechanical energy, or for driving a microgenerator to recharge an electrical energy accumulator,
- or at least one paramagnetic conductive disc 20 coaxial to said mechanical "oscillating" weight 3 comprised in said at least one watch 200 and arranged like the mechanical "oscillating" weight 3 for recharging at least one barrel or accumulator with mechanical energy, or for driving a microgenerator to recharge an electrical energy accumulator,
- or at least one magnetic "oscillating" weight 1 comprised in said at least one watch 200 and at least one paramagnetic conductive disc 20 coaxial to mechanical "oscillating" weight 3 also comprised in said at least one watch 200 for recharging at least one barrel or accumulator with mechanical energy, or for driving a microgenerator to recharge an electrical energy accumulator, for driving, depending on the case, at least one magnetic "oscillating" weight 1 or "oscillating" weight 5 with a magnet by means of magnetic coupling, and/or said at least one disc 20 by means of eddy currents.

The invention allows various winding mechanism architectures inside the watch.

The mechanical winding and magnetic/electrostatic/eddy current winding functions can therefore be disassociated, for example with elements that are each dedicated to one of these functions, oscillating one on the other, and which may or may not be integral or coupled to each other, and are preferably coaxial. This allows optimisation of each of these elements for its own function, and overall, makes it possible to limit the space requirement and mass of the winding mechanism.

The mechanical winding functions can be placed in parallel (or in series) by submitting the watch to accelerations of magnetic/electrostatic/eddy current origin.

It is easy, as a result of the invention, to convert a watch that already includes a conventional mechanical oscillating weight, by adding another recharging mobile member, magnetic oscillating weight, oscillating weight with a magnet, or paramagnetic conductive disc.

Each of these mobile members may engage with the energy accumulator, either individually, or by means of the same mechanism as the existing mechanical oscillating weight.

Disassociating the functions also makes it possible to have a rotating motion for the mechanical winding mechanism, and another motion, for example translational, for the magnetic part, or vice versa. In that case, a coupling is required between the two specific axes towards the barrel. The advantage is that other mechanical options are made available for shifting this translational motion to a smaller area of the movement. In that case, there is a reciprocal motion along an axis, and no longer only along an angular sector.

In the case of alternate working, the reciprocal motion may be limited, either by regulating and control means 320, or by a mechanical limitation, or a combination of these two solutions.

The complete, continuous and accelerated rotation of winding mobile member 50 is a particular case which is highly specific to the timepiece assembly according to the invention.

When the so-called "rotating" field is in fact alternating, it may, in a simplified embodiment, alternate in two positions on the same axis, which is very simple to achieve in a winding mechanism.

Another solution consists in setting in place a magnet which shifts on an arbor in the winding device, and drives in translation the magnetic oscillating weight 1 or the oscillating weight 5 with a magnet, depending on the case, on the side of watch 200.

Most usual movements can be wound in two directions, wherein the torque is more or less the same in both directions.

As regards movements with unidirectional winding, the weight is virtually free in one direction.

The unbalance of the weight generally varies from 70 to 300 μN·m.

The inertia is on the order of 200 g·mm2.

An example of size is based on the "ETAA16" movement: a 100% wound barrel retains the oscillating weight at an angle of 25° to 45°, which corresponds to a maximum torque of 210 μNm (=unbalance×sin 45°).

To achieve a 90° rotation of the weight, the unbalance and mainspring torques must be added together, namely approximately 500 μNm.

To ensure recharging, the dead angles of the click wheels and of the barrel click must be exceeded, i.e. a useful angular motion of at least 30° is required to pass over the click notch of the reverser mechanism and the click notch of the barrel ratchet.

For winding by means of the crown, a speed of 100 revolutions per minute must not be exceeded at the stem, which is equivalent to a speed of 4000 revolutions per minute of the oscillating weight.

2000 revolutions of the oscillating weight are typically required to completely wind the watch, for at least 72 hours of power reserve.

Sintered tungsten has a mass density of around 18 g/cm$^3$.

The core of the oscillating weight is generally made of brass, with a thickness on the order of 0.3 to 0.4 mm.

It is possible to mix tungsten balls with iron balls.

Winding device 300 according to the invention makes it possible, with a rotational speed Ω of 5 revolutions per second, to completely wind any watch in less than 5 minutes.

The air gap between the coils 305 and winding mobile member 50 is chosen to be within the range of 2 to 3 mm.

The invention claimed is:

1. A winding mobile member for an automatic watch winding mechanism comprising:

a guide to pivotably support the winding mobile member on a pivot axis thereof, and the guide is disposed at a center part of a cylinder of maximum radius that inscribes the winding mobile member;

a mechanism to drive an energy recharging mechanism;

at least one ferromagnetic or magnetized part of the automatic watch winding mechanism produces a variable magnetic field to drive the winding mobile member; and at least one moving magnetic weight, which includes a first ferromagnetic inner part extending over radii smaller than a minimum radius of a second peripheral part made of heavy metal having an atomic number of between 73 and 79, or made of an alloy including at least 80% of the heavy metal with the atomic number of between 73 and 79.

2. The winding mobile member according to claim 1, wherein the second peripheral part includes at least 50% by mass of tungsten.

3. The winding mobile member according to claim 1, wherein the second peripheral part includes at least 50% by mass of tungsten and at least 20% by mass of gold.

4. The winding mobile member according to claim 1, wherein the second peripheral part includes at least 20% by mass of iron.

5. The winding mobile member according to claim 1, wherein the first inner part is made of soft magnetic material.

6. An automatic watch winding mechanism including at least one moving mechanical weight to recharge with mechanical energy at least one barrel or mechanical energy accumulator, wherein the automatic winding mechanism includes, in addition to the at least one moving mechanical weight, at least one winding mobile member according to claim 1.

7. An automatic watch winding mechanism including at least one moving mechanical weight to recharge with mechanical energy at least one barrel or mechanical energy accumulator, wherein the at least one moving mechanical weight is a winding mobile member according to claim 1.

8. An automatic watch winding mechanism including at least one moving mechanical weight to drive a microgenerator to recharge with electrical energy an electrical energy accumulator, wherein the automatic winding mechanism includes, in addition to the at least one moving mechanical weight, at least one winding mobile member according to claim 1.

9. An automatic watch winding mechanism including at least one moving mechanical weight to drive a microgenerator to recharge with electrical energy an electrical energy accumulator, wherein the at least one moving mechanical weight is a winding mobile member according to claim 1.

10. An automatic winding mechanism including at least one moving mechanical weight to recharge with mechanical energy at least one barrel or mechanical energy accumulator or to drive a microgenerator to recharge with electrical energy an electrical energy accumulator, the automatic winding mechanism including at least one winding mobile member according to claim 1 being in addition to the at least one moving mechanical weight, wherein the at least one winding mobile member is an oscillating weight which includes at least one cut-out.

11. A timepiece movement including at least one automatic winding mechanism including at least one moving mechanical weight to recharge with mechanical energy at least one barrel or mechanical energy accumulator or to drive a microgenerator to recharge with electrical energy an electrical energy accumulator, the automatic winding mechanism including at least one winding mobile member according to claim 1 being the at least one moving mechanical weight, or being in addition to the at least one moving mechanical weight.

12. A timepiece movement including at least one microgenerator driven to recharge an accumulator with electrical energy, and at least one automatic winding mechanism including at least one moving mechanical weight to recharge with mechanical energy at least one barrel or mechanical energy accumulator or to drive a microgenerator to recharge with electrical energy the electrical energy accumulator, the automatic winding mechanism including at least one winding mobile member according to claim 1 being the at least one moving mechanical weight, or being in addition to the at least one moving mechanical weight.

13. A self-winding automatic watch including at least one automatic winding mechanism including at least one moving mechanical weight to recharge with mechanical energy at least one barrel or mechanical energy accumulator or to drive a microgenerator to recharge with electrical energy an electrical energy accumulator, the automatic winding mechanism including at least one winding mobile member according to claim 1 being the at least one moving mechanical weight, or being in addition to the at least one moving mechanical weight.

14. The winding mobile member according to claim 1, wherein the first ferromagnetic inner part connects the guide to the second peripheral part.

15. The winding mobile member according to claim 1, wherein a thickness of the first ferromagnetic inner part along the radius of the cylinder is greater than a thickness of the second peripheral part along the radius of the cylinder.

16. The winding mobile member according to claim 1, wherein the first ferromagnetic inner part and the second peripheral part form a substantially semicircle shape.

17. The winding mobile member according to claim 1, wherein the first ferromagnetic inner part includes a plurality of apertures.

18. The winding mobile member according to claim 1, wherein a maximum angular span of the first ferromagnetic inner part extending in a circumferential direction of the cylinder and a maximum angular span of the second peripheral part made of the heavy metal extending in the circumferential direction of the cylinder are the same.

19. A device for winding an automatic watch, the winding device being separate from the watch and comprising:

at least one electrical powering mechanism or one electrical accumulator;

at least one receptacle support for the watch, the receptacle support including a bearing surface configured to removably receive in abutment a back cover of the watch, the bearing surface being an outer surface of the winding device; and a mechanism to generate eddy currents disposed in a fixed position on an emission area underneath the bearing surface and generating, on at least one main sector, eddy currents that vary as a function of time, wherein the mechanism to generate eddy currents is disposed so that the emission area at least partially overlaps a trajectory of a winding mobile member of the watch along which the winding mobile member is driven by the eddy currents when the bearing surface receives in abutment the back cover of the watch.

20. A device for winding an automatic watch, the winding device being separate from the watch and comprising:

at least one electrical powering mechanism or one electrical accumulator;

at least one receptacle support for the watch, the receptacle support including a bearing surface configured to removably receive in abutment a back cover of the watch, the bearing surface being an outer surface of the winding device; and a mechanism to generate a magnetic field disposed in a fixed position on an emission area underneath the bearing surface and generating, on at least one main sector, at least one magnetic field that varies as a function of time, wherein the mechanism to generate the magnetic field is disposed so that the emission area at least partially overlaps a trajectory of a winding mobile member of the watch along which the winding mobile member is driven by the magnetic field when the bearing surface receives in abutment the back cover of the watch, and wherein the main sector includes at least one linear segment of a substantially linear emission area, the generation mechanism generates at least one magnetic field whose direction is orthogonal to the bearing surface and which varies as a function of time.

21. A device for winding an automatic watch, the winding device being separate from the watch and comprising:

at least one electrical powering mechanism or one electrical accumulator;

at least one receptacle support for the watch, the receptacle support including a bearing surface configured to removably receive in abutment a back cover of the watch, the bearing surface being an outer surface of the winding device; and a mechanism to generate an electrostatic field disposed in a fixed position on an emission area underneath the bearing surface and generating, on at least one main sector, at least one electrostatic field that varies as a function of time, wherein the mechanism to generate the electrostatic field is disposed so that the emission area at least partially overlaps a trajectory of a winding mobile member of the watch along which the winding mobile member is driven by the electrostatic field when the bearing surface receives in abutment the back cover of the watch, and wherein the main sector includes at least one linear segment of a substantially linear emission area, the generation mechanism generates, on the at least one linear segment, at least one electrostatic field whose direction is orthogonal to the bearing surface and which varies as a function of time.

22. A device for winding an automatic watch, the winding device being separate from the watch and comprising:

at least one electrical powering mechanism or one electrical accumulator;

at least one receptacle support for the watch, the receptacle support including a bearing surface configured to removably receive in abutment a back cover of the watch, the bearing surface being an outer surface of the winding device; and a mechanism to generate a magnetic field disposed in a fixed position on an emission area underneath the bearing surface and generating, on at least one main sector, at least one magnetic field that varies as a function of time, wherein the mechanism to generate the magnetic field is disposed so that the emission area at least partially overlaps a trajectory of a winding mobile member of the watch along which the winding mobile member is driven by the magnetic field when the bearing surface receives in abutment the back cover of the watch, and wherein the main sector includes at least one angular sector of a substantially annular emission area, the generation mechanism generates, on the at least one angular sector, at least one magnetic field whose direction is orthogonal to the bearing surface and which varies as a function of time.

23. A device for winding an automatic watch, the winding device being separate from the watch and comprising:

at least one electrical powering mechanism or one electrical accumulator;

at least one receptacle support for the watch, the receptacle support including a bearing surface configured to removably receive in abutment a back cover of the watch, the bearing surface being an outer surface of the winding device; and a mechanism to generate an electrostatic field disposed in a fixed position on an emission area underneath the bearing surface and generating, on at least one main sector, at least one electrostatic field that varies as a function of time, wherein the mechanism to generate the electrostatic field is disposed so that the emission area at least partially overlaps a trajectory of a winding mobile member of the watch along which the winding mobile member is driven by the electrostatic field when the bearing surface receives in abutment the back cover of the watch, and wherein the main sector includes at least one angular sector of a substantially annular emission area, the generation mechanism generates, on the at least one angular sector, at least one electrostatic field whose direction is orthogonal to the bearing surface and which varies as a function of time.

24. A device for winding an automatic watch, the winding device being separate from the watch and comprising:

at least one electrical powering mechanism or one electrical accumulator;

at least one receptacle support for the watch, the receptacle support including a bearing surface configured to removably receive in abutment a back cover of the watch, the bearing surface being an outer surface of the winding device; and a mechanism to generate a magnetic and/or electrostatic field disposed in a fixed position on an emission area underneath the bearing surface and generating, on at least one main sector, at least one field that is magnetic and/or electrostatic and/or of variable direction and/or intensity and/or sense as a function of time, wherein the mechanism to generate the magnetic and/or electrostatic field is disposed so that the emission area at least partially overlaps a trajectory of a winding mobile member of the watch along which the winding mobile member is driven by the magnetic and/or electrostatic field when the bearing surface receives in abutment the back cover of the watch, and wherein the generation mechanism generates, on the emission area, a plurality of the magnetic fields, parallel to each other in an orthogonal direction to the bearing surface and each variable as a function of time.

25. A device for winding an automatic watch, the winding device being separate from the watch and comprising:

at least one electrical powering mechanism or one electrical accumulator;

at least one receptacle support for the watch, the receptacle support including a bearing surface configured to removably receive in abutment a back cover of the watch, the bearing surface being an outer surface of the winding device; and a mechanism to generate a magnetic and/or electrostatic field disposed in a fixed position on an emission area underneath the bearing surface and generating, on at least one main sector, at least one field that is magnetic and/or electrostatic and/or of variable direction and/or intensity and/or sense as a function of time, wherein the mechanism to generate the magnetic and/or electrostatic field is disposed so that the emission area at least partially overlaps a trajectory of a winding mobile member of the watch along which the winding mobile member is driven by the magnetic and/or electrostatic field when the bearing surface receives in abutment the back cover of the watch, and wherein the generation mechanism generates, on the emission area, a plurality of the electrostatic fields, parallel to each other in an orthogonal direction to the bearing surface and each variable as a function of time.

26. A device for winding an automatic watch, the winding device being separate from the watch and comprising:

at least one electrical powering mechanism or one electrical accumulator;

at least one receptacle support for the watch, the receptacle support including a bearing surface configured to removably receive in abutment a back cover of the watch, the bearing surface being an outer surface of the winding device; and a mechanism to generate a magnetic field disposed in a fixed position on an emission area underneath the bearing surface and generating, on at least one main sector, at least one magnetic field of variable direction and/or intensity and/or sense as a function of time, wherein the mechanism to generate the magnetic field is disposed so that the emission area at least partially overlaps a trajectory of a winding mobile member of the watch along which the winding mobile member is driven by the magnetic field when the bearing surface receives in abutment the back cover of the watch, and wherein the generation mechanism includes an array of coils on all or part of the emission area.

27. A timepiece assembly comprising:

a device to wind automatic watches, including at least one electrical powering mechanism or one electrical accumulator, at least one receptacle support for a watch, the receptacle support including a bearing surface configured to receive in abutment a back cover of the watch, a mechanism to generate a magnetic field disposed in a fixed position on an emission area underneath the bearing surface and generating, on at least one main sector, at least one field that is magnetic and/or electrostatic and/or of variable direction and/or intensity and/or sense as a function of time or eddy currents that vary as a function of time;

at least one watch including an automatic winding mechanism which includes at least one moving mechanical weight to recharge with mechanical energy at least one barrel or mechanical energy accumulator or to drive a microgenerator to recharge with electrical energy an electrical energy accumulator, the automatic winding mechanism including at least one winding mobile member, the winding mobile member including:

a guide to pivotably support the winding mobile member on a pivot axis thereof, and the guide is disposed at a center part of a cylinder of maximum radius that inscribes the winding mobile member, a mechanism to drive an energy recharging mechanism, at least one ferromagnetic or magnetized part to drive the winding mobile member by a variable magnetic field, and at least one moving magnetic weight, which includes a first ferromagnetic inner part extending over radii smaller than a minimum radius of a second peripheral part made of heavy metal having an atomic number of between 73 and 79, or made of an alloy including at least 80% of the heavy metal with the atomic number of between 73 and 79, the winding mobile member forms the moving mechanical weight or is in addition to the at least one moving mechanical weight; and a regulating and control device to control the generation mechanism, wherein the regulating and control device and the generation mechanism are configured and formatted to drive:

either the at least one moving magnetic weight comprised in the at least one watch, to recharge the at least one barrel or accumulator with mechanical energy, or to drive the microgenerator to recharge the electrical energy accumulator, or at least one paramagnetic conductive disc coaxial to the moving mechanical weight comprised in the at least one watch, and, as the at least one moving mechanical weight, configured to recharge the at least one barrel or accumulator with mechanical energy, or to drive the microgenerator to recharge the electrical energy accumulator, or the at least one moving magnetic weight comprised in the at least one watch and the at least one paramagnetic conductive disc coaxial to the moving mechanical weight also comprised in the at least one watch to recharge the at least one barrel or accumulator with mechanical energy, or to drive the microgenerator to recharge the electrical energy accumulator, and to drive, depending on a case, the at least one moving magnetic weight by magnetic coupling, and/or the at least one disc by eddy currents.

28. A timepiece assembly comprising:

a device to wind automatic watches, including at least one electrical powering mechanism or one electrical accumulator, at least one receptacle support for a watch, the receptacle support including a bearing surface configured to receive in abutment a back cover of the watch, a mechanism to generate a magnetic field disposed in a fixed position on an emission area underneath the bearing surface and generating, on at least one main sector, at least one field that is magnetic and/or electrostatic and/or of variable direction and/or intensity and/or sense as a function of time or eddy currents that vary as a function of time;

at least one watch including an automatic winding mechanism which includes at least one moving mechanical weight to recharge with mechanical energy at least one barrel or mechanical energy accumulator or to drive a microgenerator to recharge with electrical energy an electrical energy accumulator;

the automatic winding mechanism including at least one winding mobile member, the winding mobile member including:

a guide to pivotably support the winding mobile member on a pivot axis thereof, and the guide is disposed at a center part of a cylinder of maximum radius that inscribes the winding mobile member, a mechanism to drive an energy recharging mechanism, at least one ferromagnetic or magnetized part to drive the winding mobile member by a variable magnetic field, and at least one moving magnetic weight, which includes a first ferromagnetic inner part extending over radii smaller than a minimum radius of a second peripheral part made of heavy metal having an atomic number of between 73 and 79, or made of an alloy including at least 80% of the heavy metal with the atomic number of between 73 and 79, the winding mobile member forms the moving mechanical weight or is in addition to the at least one moving mechanical weight; and a regulating and control device to control the generation mechanism and wherein the regulating and control device and the generation mechanism are configured and formatted:

either to drive by eddy currents at least one paramagnetic conductive disc coaxial to the moving mechanical weight comprised in the at least one watch, and, as the at least one moving mechanical weight, configured to recharge the at least one barrel or accumulator with mechanical energy, or to drive the microgenerator to recharge the electrical energy accumulator, or to drive by magnetic coupling the at least one moving magnetic weight comprised in the at least one watch and to drive by eddy currents the at least one paramagnetic conductive disc coaxial to the moving mechanical weight also comprised in the at least one watch to recharge the at least one barrel or accumulator with mechanical energy, or to drive the microgenerator to recharge the electrical energy accumulator.

* * * * *